US006775611B2

(12) United States Patent
Kobayashi et al.

(10) Patent No.: US 6,775,611 B2
(45) Date of Patent: Aug. 10, 2004

(54) ENGINE CONTROL APPARATUS

(75) Inventors: Hidetoshi Kobayashi, Anjo (JP); Ken Uchiyama, Toyoake (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/356,543

(22) Filed: Feb. 3, 2003

(65) Prior Publication Data

US 2003/0163247 A1 Aug. 28, 2003

(30) Foreign Application Priority Data

Feb. 26, 2002 (JP) ..... 2002-049948

(51) Int. Cl.[7] ..... G06G 7/70

(52) U.S. Cl. ..... 701/114; 123/406.18; 123/406.62; 701/115; 701/113

(58) Field of Search ..... 701/110, 114, 701/115, 113; 123/406.18, 406.58, 185.13, 406.24, 406.62, 406.63, 406.61, 406.59

(56) References Cited

U.S. PATENT DOCUMENTS 4,869,221 A * 9/1989 Abe ..... 123/406.62
4,870,587 A * 9/1989 Kumagai ..... 701/110
4,966,116 A * 10/1990 Sakurai Hidetoshi .. 123/406.18
6,591,184 B2 * 7/2003 Yonezawa et al. ..... 701/113

FOREIGN PATENT DOCUMENTS

| | | |
|---|---|---|
| JP | U-3-1239 | 1/1991 |
| JP | A-5-133268 | 5/1993 |
| JP | A-2002-97990 | 4/2002 |

* cited by examiner

*Primary Examiner*—Willis R. Wolfe
*Assistant Examiner*—Johnny H. Hoang
(74) *Attorney, Agent, or Firm*—Nixon & Vanderhye P.C.

(57) ABSTRACT

A crank sensor outputs a crank signal including an angle indicating part and a reference position indicating part. A cam sensor outputs a cam signal including an angle indicating part and a reference position indicating part. A microcomputer executes a cylinder determining processing using the crank signal alone, and also executes a cylinder determining processing using the cam signal alone. In addition, the microcomputer detects abnormality of the crank signal and the cam signal. The cylinder determining processing using the crank signal alone is prohibited when both the crank signal and the cam signal become abnormal while operating the engine. Then, the prohibition of the cylinder determining processing is withdrawn on the condition that the cam signal is recovered to normal.

22 Claims, 7 Drawing Sheets

ENGINE CONTROL APPARATUS

CROSS REFERENCE TO RELATED APPLICATIONS

This application is based on Japanese Patent Application No. 2002-49948 filed on Feb. 26, 2002 the contents of which are incorporated herein by reference.

BACKGROUND OF THE INVENTION

1. Field of the Invention

The present invention relates to an engine control apparatus for executing a cylinder determining processing of a multi-cylinder engine by using a crank sensor and a cam sensor.

2. Description of Related Art

As this type of conventional technology, a cylinder determining and detecting apparatus for an internal combustion engine disclosed in JP-A-5-133268 is known in the art. According to the apparatus disclosed in the document, it discloses a method for detecting rotation of a crankshaft and a camshaft of a four-cycle engine by a crank sensor and a cam sensor respectively, and for executing a cylinder determining processing on the basis of the detecting results of the sensors.

More specifically, the crank sensor has a rotor the outside of which is provided with protrusions in even intervals and with an absence tooth portion which is formed by removing a part of the protrusions. The cam sensor has a rotor the outside of is provided with protrusions in even intervals and with an auxiliary tooth in one location. The absence tooth portion and the auxiliary tooth correspond to a predetermined angular position, e.g., top dead center, of a predetermined particular cylinder. Therefore, it is possible to determine the cylinder based on the crank sensor alone. It is also possible to determine the cylinder based on the cam sensor alone. In addition, it is also proposed that a method for executing a cylinder determining processing on the basis of a combination of the detected signals of both sensors.

According to the apparatus in the above document, even if one of the crank sensor and the cam sensor fails, it is still capable to execute the cylinder determining processing in a successful manner using the other one of the sensor signals.

However, a detection of the absence tooth of the crank sensor is executed every rotation of the crankshaft, that is every 360° CA. In case of the multi-cylinder four-cycle engine, the absence tooth is detected at predetermined angular position, e.g., top dead center, of two cylinders. Therefore, in case of that the cylinder determining processing is temporarily suspended due to abnormalities of both the crank sensor and the cam sensor while the engine is operated, even if only the crank sensor is recovered to normal, it is impossible to determine the particular one of the cylinders based on the cylinder determining processing using the crank sensor alone.

In that case, if an engine speed is low such as during the starting of the engine, a serious problem would not arise, since even if an incorrect cylinder is determined, it merely causes an engine stall or the like. However, if an incorrect cylinder is determined under a normal operating condition, e.g., under a high-speed rotation, several problems may arise, since the engine will rotate continuously due to an inertia of itself. For example, by injecting fuel to the incorrectly determined cylinder, it may cause problems such as emissions of unburned fuel and damages of the engine.

SUMMARY OF THE INVENTION

The present invention was accomplished in consideration of the above-mentioned circumstances. It is therefore an object of the present invention to provide an engine control apparatus that is capable of executing the cylinder determining processing in an appropriate manner, and resolving the above-mentioned problems due to an incorrect cylinder determination.

According to a first aspect of the present invention, a crank sensor detects rotation of a crankshaft, and outputs a crank signal including angle indicating parts and reference position indicating parts. In addition, a cam sensor detects rotation of a camshaft, and outputs a cam signal including angle indicating parts and reference position indicating parts. The apparatus is provided with a first cylinder determining means and a second cylinder determining means as means for determining cylinder. The cylinder determination is carried out on the basis of the crank signal, and the cylinder determining processing is carried out on the basis of the cam signal too. A sensor signal abnormality detecting means detects an abnormality of the crank signal and the cam signal respectively. A cylinder determination controlling means prohibits the cylinder determining processing of the first cylinder determining means when both the crank signal and the cam signal become abnormal while operating the engine. Then, the cylinder determination controlling means withdraws the prohibition of the cylinder determining processing on the condition that the cam signal is recovered normal.

In the case when a previously executed cylinder determining processing is suspended due to the abnormalities of both the crank signal and the cam signal, the cylinder determining processing may be resumed if the cam signal is recovered to normal. In this case, even if the crank signal is recovered earlier, the cylinder determining processing using the crank signal alone is still prohibited. If the crank signal is still abnormal when the cam signal is recovered, the cylinder determining processing is executed by using the cam signal alone. There is a possibility to make an incorrect cylinder determination on the basis of the crank signal alone. However, the incorrect cylinder determination can be prevented since the cam signal enables a determination of one particular cylinder by using itself alone. As a result, by executing the cylinder determining processing of the engine in an appropriate manner, it is possible to resolve several problems due to the incorrect cylinder determination.

The cylinder determining processing may be prohibited on the condition that an engine speed is higher than a predetermined speed in addition to the condition that both the crank signal and the cam signal are abnormal.

A result of the cylinder determining processing may be inverted oppositely when it is not detected to increase an engine speed by monitoring change of the engine speed after a completion of the cylinder determining processing of the first cylinder determining means when starting the engine. In the starting of the engine, even if the cylinder is incorrectly determined, it merely makes it difficult to start the engine, and the engine is not damaged. It is possible to determine the cylinder correctly by just inverting the result of the cylinder determination in a relationship of a front side and a backside. Here, in case of the four-cycle engine, two cylinders distanced by 360° CA are considered as the cylinders in the front side and the backside.

The prohibition of the cylinder determining processing caused by the cylinder determination controlling means may be withdrawn when the engine stalls. In this case, since a restarting operation might be carried out if an engine stall occurs, it is possible to execute the cylinder determining processing using the crank signal alone even if the cam signal is continuously abnormal.

The cylinder determining processing may be executed by referring to reference position detecting data of the cam signal in response to the detection of the reference position of the crank signal. In this case, the results of the cylinder determining processing are stored as a history at every time of the cylinder determining processing. Then, the result of the cylinder determining processing is examined to determine whether or not it is correct on the basis of the history characterized by a plurality of results of succeeded cylinder determining processing. In case of executing the cylinder determining processing on the basis of a combination of the crank signal and the cam signal, there is a possibility to make an incorrect cylinder determination if a pulse is incorrectly recognized due to a noise or the like. On the contrary, according to the invention, it is possible to achieve an anti-noise measure.

The prohibition of the cylinder determining processing may be withdrawn on the condition that an engine speed is decreased to a predetermined speed after both the crank signal and the cam signal became abnormal. Although the crankshaft and the camshaft are mechanically coupled and rotate in keeping an angular synchronousness, an angular position between them might be shifted in a high-speed rotation. For example, in case of coupling the crankshaft and the camshaft by a chain, a phase difference may appear between the crank signal and the cam signal at the high-speed rotation. Taking such circumstances into consideration, it is preferable to withdraw the prohibition of the cylinder determining processing only when the engine is operated in a low-speed range, less than a predetermined speed. Thereby, a reliability of the cylinder determining processing is improved.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF PREFERRED EMBODIMENTS

Hereinafter, an embodiment implementing the present invention is explained with reference to the drawings. In the embodiment, a four-cycle six-cylinder diesel engine is exemplified. An engine control apparatus for detecting a rotation of the engine and for carrying out a fuel injection control and the like based on the rotating condition is explained.

Figure 1:
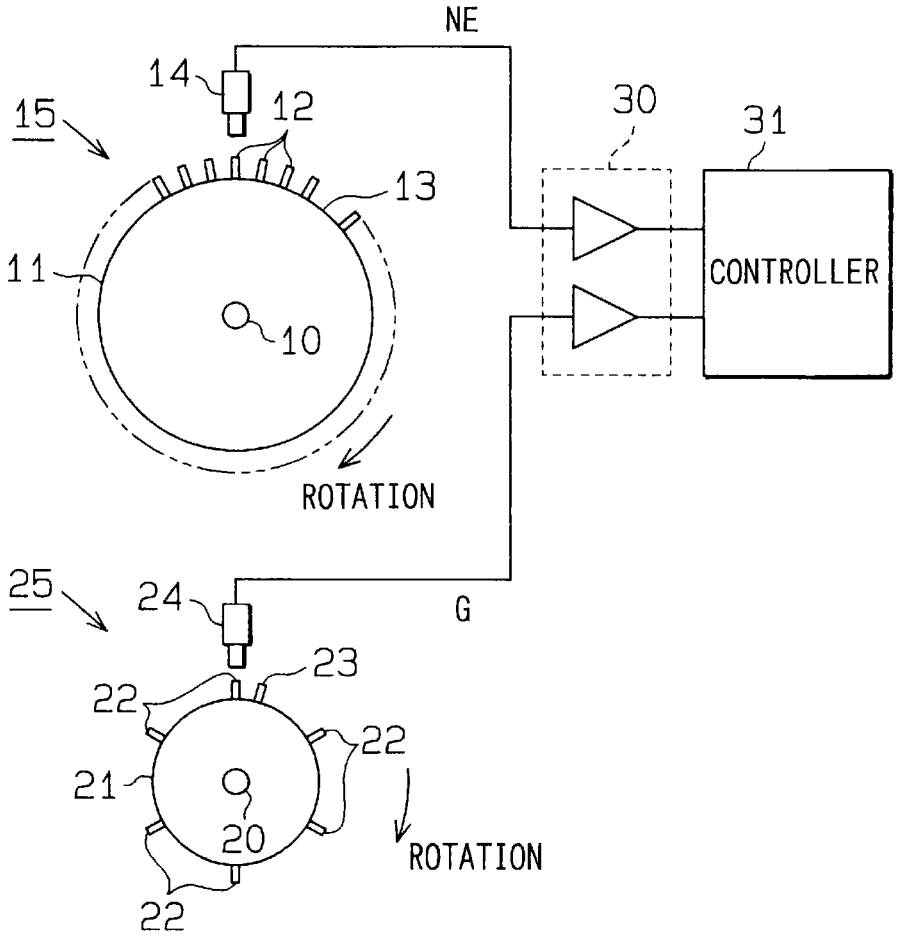
FIG. 1 is a schematic diagram showing an engine control apparatus according to an embodiment of the present invention.

As shown in FIG. 1, a disk shaped NE rotor 11 is fixed on a crankshaft 10 of the engine. A plurality of protrusions 12 are formed on an outer periphery of the NE rotor 11 in every predetermined rotation angle intervals of the crankshaft 10, that is 15°CA in the embodiment. An absence tooth portion 13 is formed by removing one tooth out of the plurality of protrusions 12 at the vicinity of the particular cylinder, e.g., the vicinities of the top dead center, TDC, of the first cylinder and the sixth cylinder. Therefore, a total of 23 of the protrusions 12 are formed on the NE rotor 11.

An electromagnetic pickup coil 14 is disposed adjacent to the outer periphery of the NE rotor 11. The electromagnetic pickup coil 14 generates signal in response to every passing of the protrusions 12. The detected signal of the electromagnetic pickup coil 14 is inputted in a waveform shaping circuit 30 and shaped into pulses. The NE rotor 11 and the electromagnetic pickup coil 14 provide a crank sensor 15.

A camshaft 20 synchronously rotates with the crankshaft 10 of the engine, and makes one rotation during which the crankshaft 10 rotates twice. A disk shaped cam rotor 21 is fixed on the camshaft 20. Protrusions 22 for the number of cylinders are formed on an outer periphery of the cam rotor 21 in even intervals. The embodiment exemplifies the six-cylinder engine, therefore, the protrusions 22 are formed on the outer periphery of the cam rotor 21 in every 60 degrees, that is 120° CA of crank angle. For example, each of the protrusions 22 is formed on a position 45° CA before TDC of each cylinder of the engine. In addition, an auxiliary tooth 23 is formed on the outer periphery of the cam rotor 21 on just before the protrusion corresponding to the first cylinder. In this embodiment, the auxiliary tooth 23 is formed on a position 75° CA before TDC of the first cylinder.

An electromagnetic pickup coil 24 is disposed adjacent to the outer periphery of the cam rotor 21. The electromagnetic pickup coil 24 generates signal in response to every passing of the protrusions 22 and the auxiliary tooth 23. The detected signal of the electromagnetic pickup coil 24 is inputted in a waveform shaping circuit 30 and shaped into pulses. The cam rotor 21 and the electromagnetic pickup coil 24 provide a cam sensor 25.

A microcomputer, hereinafter referred to as a controller, 31 is configured as a well-known logic circuit having a CPU, ROM, RAM and the like. The controller 31 executes an engine speed computing processing and a cylinder determining processing on the basis of the detected crank signal of the crank sensor 15 and the detected cam signal of the cam sensor 25 which are inputted via the waveform shaping circuit 30. In addition, the controller 31 executes several controls such as fuel injection, injection timing, injection pressure, on the basis of the results of the cylinder determining processing and the engine speed computing processing.

Figure 2:
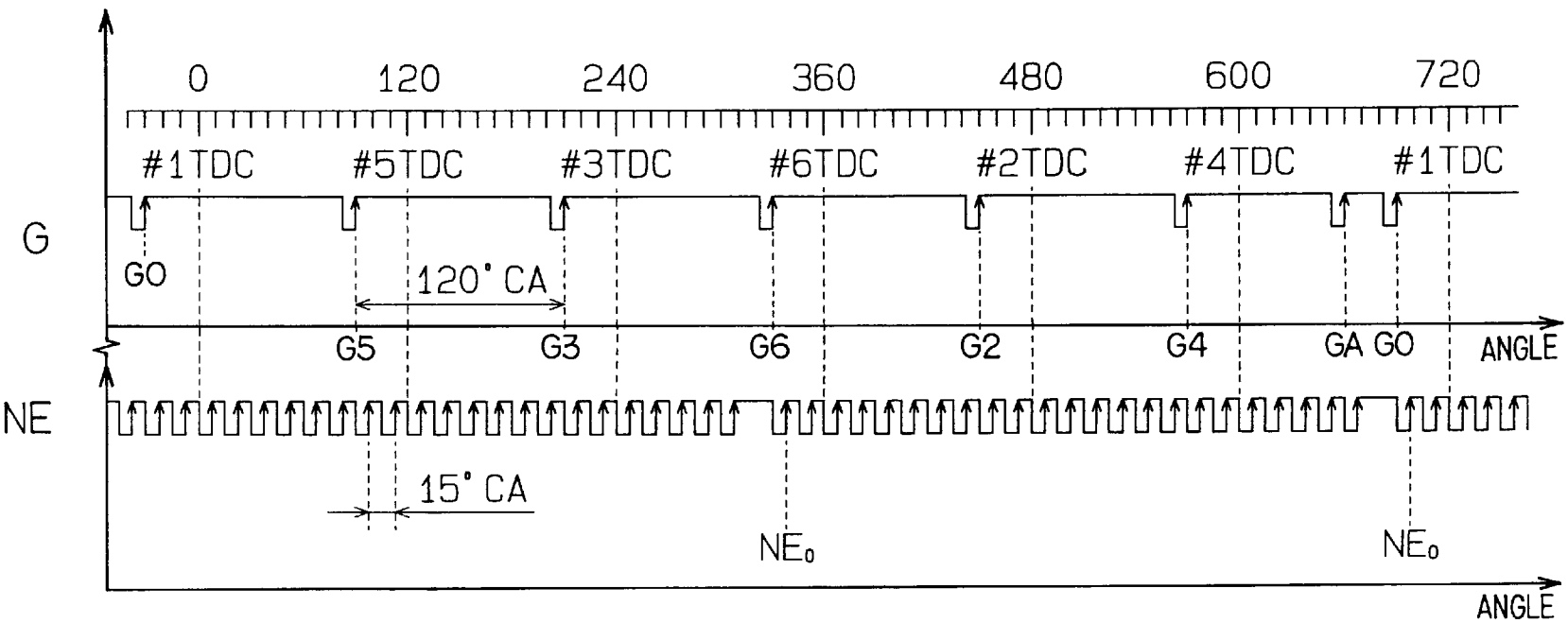
FIG. 2 is a time chart showing signal form of a crank signal and a cam signal according to the embodiment of the present invention.

FIG. 2 is a time chart showing signal shapes of the crank signal and the cam signal. In FIG. 2, a firing order of the cylinders is 1-5-3-6-2-4. Therefore, the TDC of the first cylinder #1TDC and the TDC of the sixth cylinder #6TDC are arranged in a relationship of a front side and a backside which are distanced by just 360° CA.

In FIG. 2, the crank signal is shown as a pulse train with 15° CA intervals, and has absence tooth parts 13 just before the #1TDC and just before the #6TDC. The appearance of the absence tooth parts 13 are used for detecting the #1TDC and the #6TDC. In this case, when the absence tooth corresponding to the #1TDC is assumed as a front side absence tooth, the absence tooth corresponding to the #6TDC is assumed as a backside absence tooth.

The cam signal is shown as a pulse train with 120° CA intervals, and has the auxiliary tooth pulse corresponding to the auxiliary tooth 23. In the illustrated embodiment, the auxiliary tooth pulse appears just before a cam pulse corresponding to the #1TDC, which is shown as G0 in the drawing. The appearance of the auxiliary tooth pulse is once within 720° CA. Therefore, by detecting an existence or absence of the auxiliary tooth pulse within a predetermined period just before a detection of the absence tooth of the crank signal, e.g., 60° CA before NE0 in the drawing, it is possible to determine whether the #1TDC, the front absence tooth, or the #6TDC, the backside absence tooth.

In the embodiment, the pulse train part with 15° CA intervals in the crank signal corresponds to an angle indicating part, and the absence tooth part corresponds to a reference position indicating part. Similarly, the pulse train part with 120° CA intervals in the cam signal corresponds to an angle indicating part, and the auxiliary tooth pulse corresponds to a reference position indicating part. The settings such as the pulse intervals of 15° CA and 120° CA may be modified.

Next, processing of the cylinder determining and an abnormality determination of respective sensor signals of the controller 31 is explained with reference to flowcharts shown in FIGS. 3–7.

Figure 3:
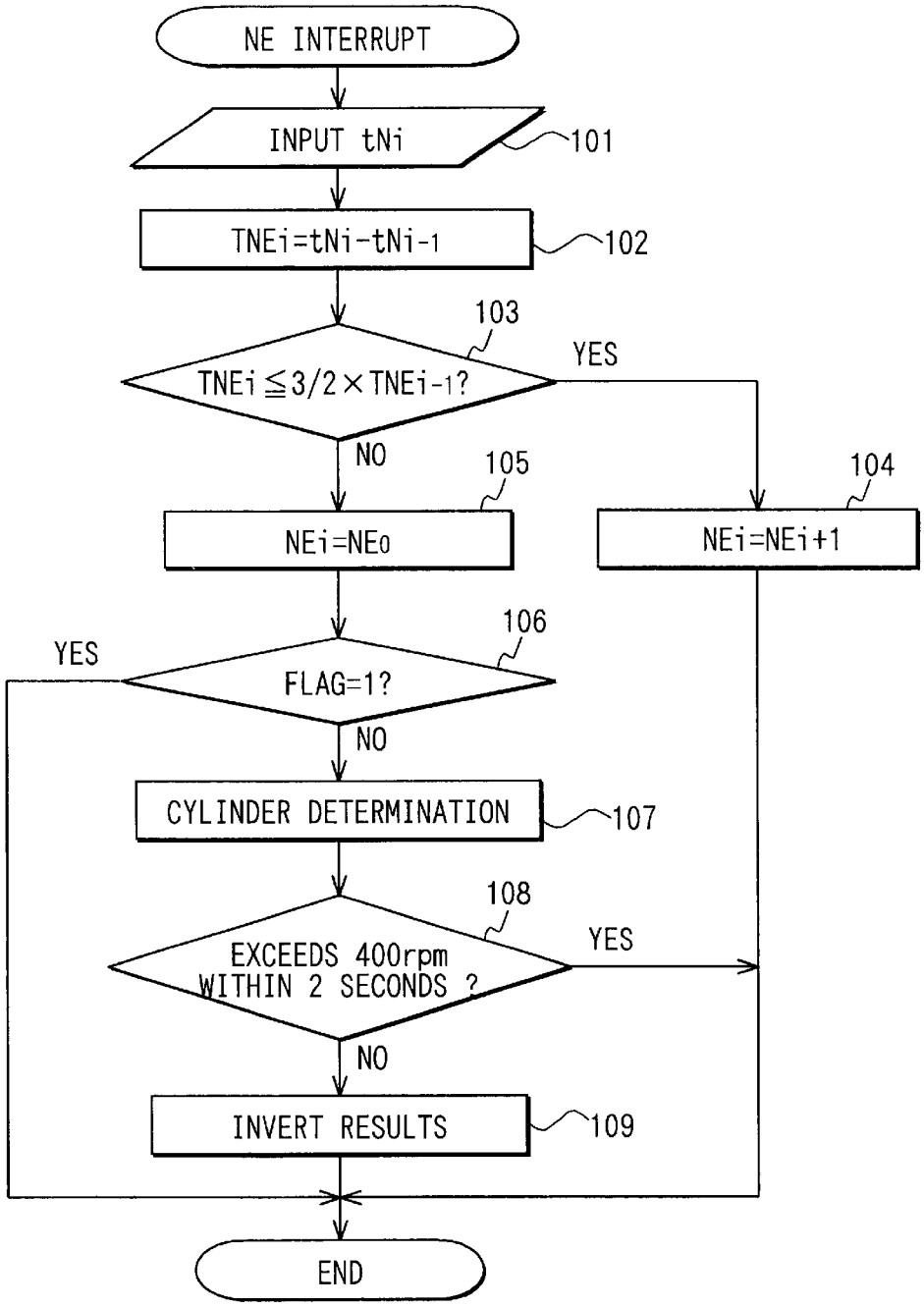
FIG. 3 is a flowchart showing a crank signal interruption processing according to the embodiment of the present invention.

FIG. 3 is a flowchart showing a crank signal interrupt routine which is started in response to a rising edge of the crank signal by the controller 31. The routine executes the cylinder determining processing using the crank signal alone.

First, in step 101, a present time tNi of the crank signal interruption is inputted, then in following step 102, a pulse interval TNEi is computed on the basis of the present value tNi and the last value tNi-1 of the crank signal interruption time, that is TNEi=tNi−tNi-1. In step 103, it is determined that whether or not the pulse interval TNEi is equal to or smaller than 3/2×TNEi-1. If a determination is YES, the routine proceeds to step 104, and increments NEi.

If the determination is NO, it is considered that it reaches to the reference position, that is a crank pulse just after the absence tooth, at the present crank signal interruption, a crank pulse number NEi is set NE0 in step 105. Then, in step 106, it is determined that whether or not the cylinder determining processing using the crank signal alone is prohibited at the present on the basis of a flag showing a prohibition of crank only determination. The flag shows the prohibition of the cylinder determining processing using the crank signal alone when 1 is set. The routine proceeds to the following step 107 on the condition that the flag=0.

In step 107, the cylinder determining processing using the crank signal alone is executed. In this case, even if the reference position is detected by the crank signal, it is impossible to determine whether it corresponds to the #1TDC, the front side absence tooth, or the #6TDC, the backside absence tooth. As an example, it will be assumed that the determination is the #1TDC, the front side absence tooth. Then, the #1TDC, the front side absence tooth, and the #6TDC, the backside absence tooth are alternately determined in response to later every detection of the reference position.

After that, in step 108, it is determined whether or not the engine speed exceeds 400 rpm within two (2) seconds after a completion of the cylinder determining processing. In case of YES in step 108, it is assumed that the result of the cylinder determining processing in step 107 was correct and the engine starting was succeeded, and the routine is finished. On the contrary, in case of NO in step 108, it is assumed that the result of the cylinder determining processing in step 107 was incorrect and the engine starting was not successful, then the routine proceeds to step 109. In step 109, the front side or the backside of the result of the cylinder determining processing is inverted. That is, if the result was that the #1TDC, the front side absence tooth, was determined, the result is inverted to the #6TDC, the backside absence tooth.

Figure 4:
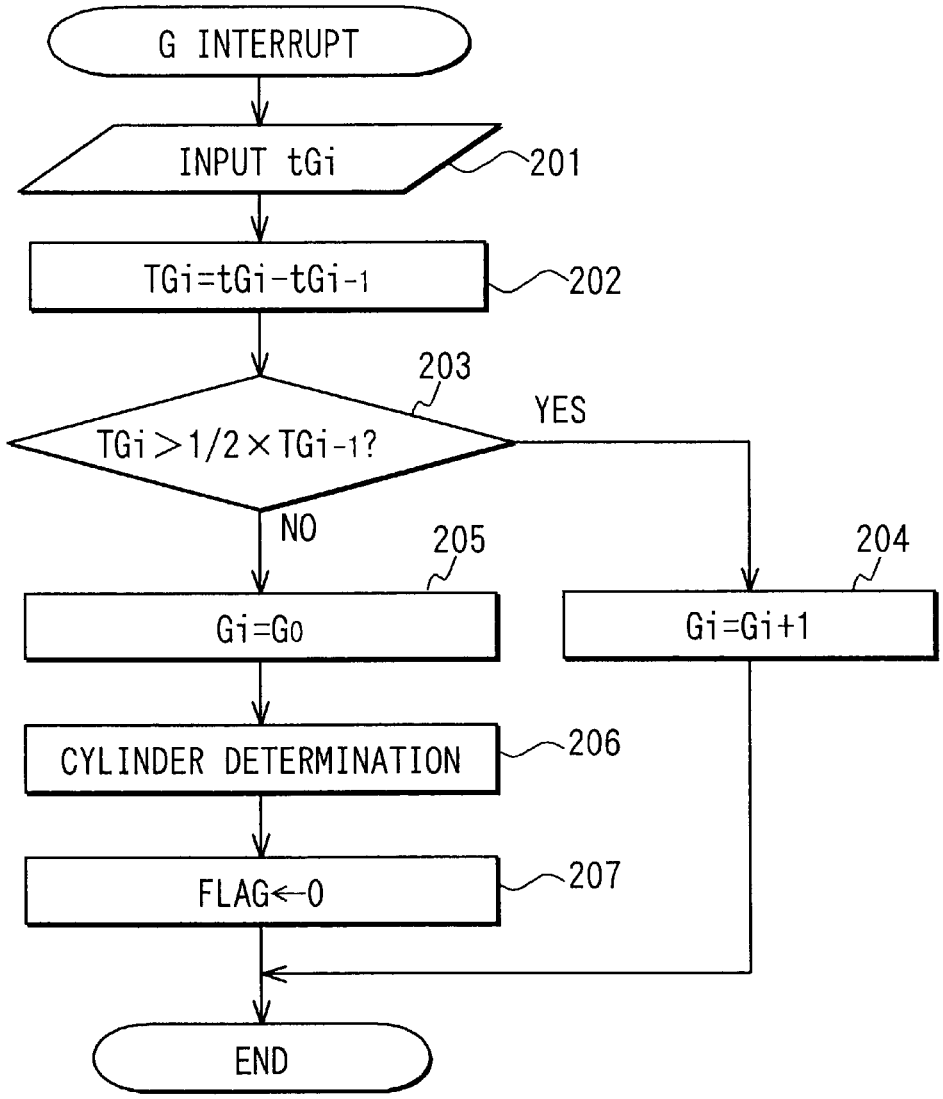
FIG. 4 is a flowchart showing a cam signal interruption processing according to the embodiment of the present invention.

FIG. 4 is a flowchart showing a routine of a cam signal interruption processing which is started by the controller 31 in response to a rising edge of the cam signal. The routine executes the cylinder determining processing using the cam signal alone.

In FIG. 4, first, in step 201, a present time tGi of the cam signal interruption is inputted, then in following step 202, a pulse interval TGi is computed on the basis of the present value tGi and the last value tGi-1 of the cam signal interruption time, that is TGi=tGi−tGi-1. In step 203, it is determined that whether or not the pulse interval TGi is equal to or smaller than 1 / 2×TGi-1. If a determination is YES, the routine proceeds to step 204, and increments a cam pulse number Gi.

If the determination is NO in step 203, it is assumed that it is reached to the reference position, the cam pulse just after the auxiliary tooth pulse, at the present cam signal interruption, the cam pulse number Gi is set G0 in step 205. After that, in step 206, the cylinder determining processing using the cam signal alone is executed. In this case, a detection of the reference position of the cam signal is determined as the #1TDC, the front side absence tooth. In conclusion, in step 207, a flag indicative of a prohibition of a crank only determination is cleared.

Incidentally, in comparison with the crank signal to the cam signal, the former one is significantly more frequent than the latter one. Therefore, in a normal condition, the result of the cylinder determining processing using the crank signal alone is used with priority. On the contrary, in an abnormal condition of the crank signal, the result of the cylinder determining processing using the cam signal alone become effective. In case of FIG. 3 and FIG. 4, a processing for computing the engine speed based on the pulse intervals TNEi and TGi may be added.

Figure 5:
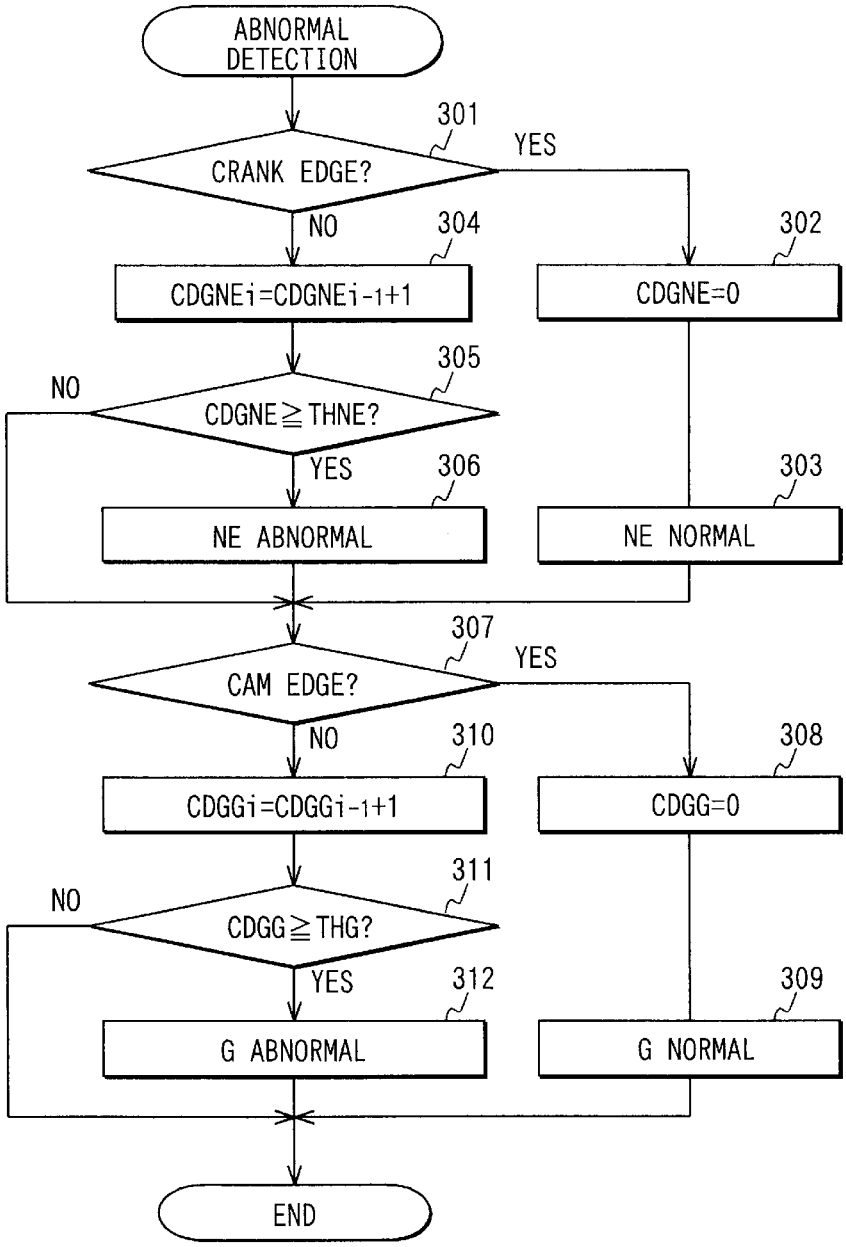
FIG. 5 is a flowchart showing an abnormality detecting processing for the crank signal and cam signal according to the embodiment of the present invention.

FIG. 5 is a flowchart showing a routine of a processing for detecting abnormalities of the crank signal and the cam signal. The routine is cyclically executed every predetermined period, e.g., four, 4, milliseconds, by the controller 31.

In FIG. 5, first, in step 301, it is determined that whether or not an edge, e.g., a rising edge, of the crank signal appears. If the edge has been detected just before, the routine proceeds to step 302, and clears a crank signal abnormality monitoring counter CDGNE to 0. In the following step 303, it is determined that the crank signal is normal.

If the edge has not been detected, the routine proceeds to step 304, an increments the abnormality monitoring counter CDGNE. In the following step 305, it is determined whether or not the value of CDGNE becomes equal to or greater than a predetermined value THNE. Here, the result of YES in step 305 indicates that no crank edge is detected during a predetermined period, that is the loss of inputting of the crank signal. In this case, the routine proceeds to step 306, and determines that the crank signal is abnormal.

After that, in step 307, it is determined that whether or not an edge, e.g., a rising edge, of the can signal appears. If the edge has been detected just before, the routine proceeds to step 308, and clears a cam signal abnormality monitoring counter CDGG to 0. In the following step 309, it is determined that the cam signal is normal.

If the edge has not been detected, the routine proceeds to step 310, an increments the cam signal abnormality monitoring counter CDGG. In the following step 311, it is determined whether or not the value of CDGG becomes equal to or greater than a predetermined value THG. Here, the result of YES in step 311 indicates that no cam edge is detected during the predetermined period, that is the loss of inputting of the cam signal. In this case, the routine proceeds to step 312, and determines that the cam signal is abnormal.

Figure 6:
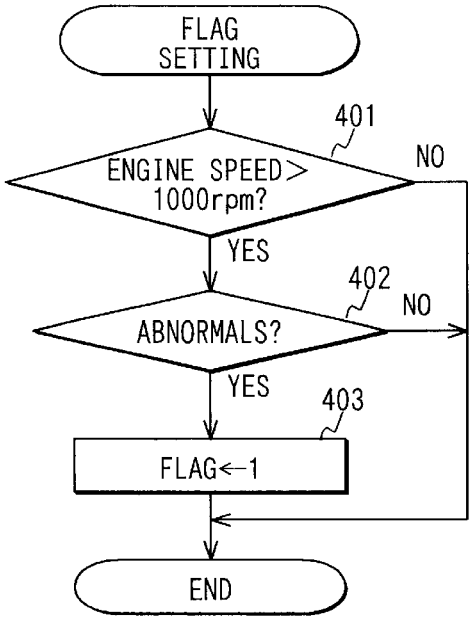
FIG. 6 is a flowchart showing a setting processing of a flag indicative of a prohibition of crank only determination according to the embodiment of the present invention.
Figure 7:
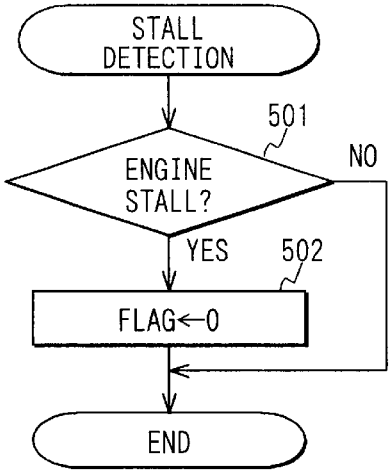
FIG. 7 is a flowchart showing an engine stall processing according to the embodiment of the present invention.

FIG. 6 is a flowchart showing a processing for setting the flag indicative of the prohibition of the crank only determination. The processing is executed as a periodical processing with predetermined cycle by the controller 31. In step 401, it is determined that whether or not the engine speed is equal to or higher than a value, e.g., 1000 rpm. Thereby, it is determined that whether or not the engine rises higher than a starting condition and is running at a certain level of high-speed range. In addition, in step 402, it is determined that whether or not both the crank signal and the cam signal are abnormal.

Then, on the condition that both steps 401 and 402 are YES, the flag is set 1 in step 403. Incidentally, if the engine is not high-speed, it is not necessary to prohibit the cylinder determining processing positively, since it is expected that the engine would stall just after an occurrence of abnormality such as an output failure of both the crank signal and the cam signal. Therefore, a high-speed of the engine is considered as a condition for prohibiting the cylinder determining process.

According to the above described operation, although the flag is cleared in response to a recovery of the cam signal to normal, in step 207 in FIG. 4, besides the flag may be cleared in response to the engine stall. That is, in the engine stall processing shown in FIG. 7, it is determined that whether or not the engine stalls, step 501, and the flag is cleared to 0 in response to the engine stall, step 502. In addition, the prohibition of the cylinder determining processing may be withdrawn on the condition that the engine speed is decreased to a predetermined speed after both the crank signal and the cam signal became abnormal.

Figure 8:
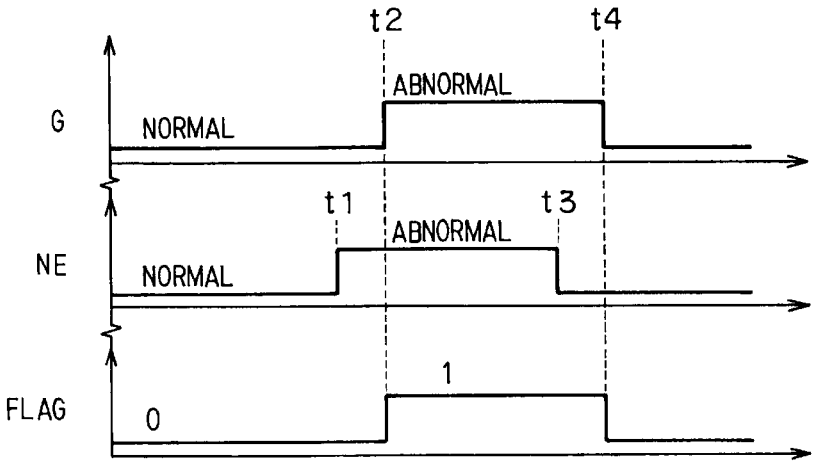
FIG. 8 is a time chart showing waveforms in the engine control apparatus according to the embodiment of the present invention.

FIG. 8 is a time chart showing detail of operation of the above-described processing.

In FIG. 8, at timings t1, t2, inputting of the crank signal and the cam signal to the controller 31 are stopped due to a malfunction of the sensor and a break down of a signal line and the like. The occurrences of the abnormality of the signals are determined. In the timing t2, the flag is set on the condition that the engine is in the certain level of high-speed.

After that, even if the crank signal is recovered to normal in advance at timing t3, the cylinder determining processing using the crank signal alone is prohibited since the flag is not cleared at this time. Then, the cam signal is recovered to normal at timing t4, the flag is cleared and the cylinder determining processing using the crank signal alone is permitted. After t4, the cylinder determining processing is resumed. In case of recovering normal the cam signal is earlier, the cylinder determining processing using the cam signal alone is commenced at a time recovering the cam signal.

In a period between t2–t4, any cylinder determining processing is not executed, and the controls such as the fuel injection are also suspended. However, if the engine is operated in a condition at certain level of high-speed, the engine keeps running due to its inertial rotation. Therefore, it is possible to operate the engine continuously after the timing t4.

Figure 9:
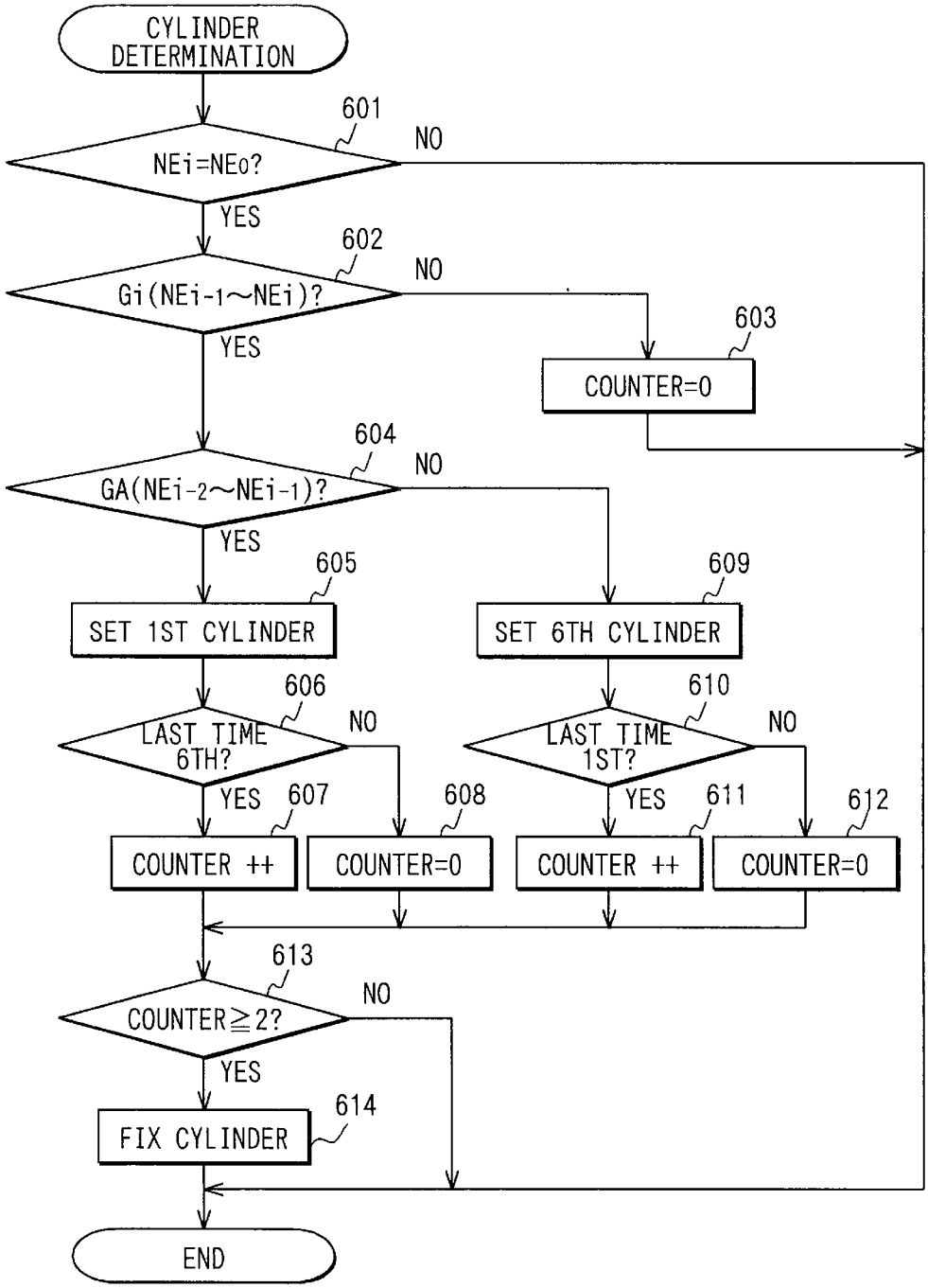
FIG. 9 is a flowchart showing a cylinder determining processing using a combination pattern according to another embodiment of the present invention.

Next, a method for executing the cylinder determining processing using a combination pattern using both the crank signal and the cam signal is explained. FIG. 9 shows a cylinder determining process. The processing is executed in an interrupt manner in response to the rising edge of the crank signal by the controller 31. The processing is designed to prevent an incorrect cylinder determination due to a noise, and counts a history counter at every determination of the cylinder determining processing and executes a final cylinder determining processing based on the history counter value.

In FIG. 9, first, in step 601, it is determined that whether the crank pulse number NEi is equal to NE0 indicating the reference position. In case of YES, the routine proceeds to step 602. After that, in step 602, it is determined whether or not one inputting of the cam pulse is detected between NEi and NEi-1. If the result is NO, the routine proceeds to step 603, and clears the history counter.

In step 604, it is determined that whether or not an auxiliary tooth cam pulse is inputted between NEi-1 and NEi-2.If step 604 was YES, the routine proceeds to step 605, and temporarily set the first cylinder, #1TDC, as the present cylinder. In the following steps 606–608, if the last time was the sixth cylinder, #6TDC, the history counter is incremented, and if the last time was not the sixth cylinder, #6TDC, the history counter is cleared.

In addition, if step 604 was NO, the routine proceeds to step 609, and temporarily set the sixth cylinder, #6TDC, as the present cylinder. In the following steps 610–612, if the last time was the first cylinder, #1TDC, the history counter is incremented, and if the last time was not the first cylinder, #1TDC, the history counter is cleared.

After that, in step 613, it is determined that whether or not the history counter is equal to or higher than a predetermined value, that is two in this embodiment. In case of YES, the routine proceeds to step 614, and finally fixes the temporary set cylinder.

In case of executing the cylinder determining processing using the crank signal and the cam signal, if the auxiliary tooth of the cam signal is erroneously detected due to an occurrence of a noise or the like, the cylinder may be incorrectly determined. Therefore, in order to prevent an incorrect cylinder determination, it may be considered to stop the cylinder determining processing using the combination of both signals except for the engine starting. However, it is possible to realize an anti-noise measure by fixing the cylinder determination from a-succeeding results of the cylinder determining process, temporary results, based on the history of the cylinder determining processing as shown in FIG. 9.

According to the embodiments described above, the following advantages are achieved.

Since a restart of the cylinder determining processing using the crank signal alone is prohibited after both the crank signal and cam signal become abnormal while operating the engine normally, it is possible to prevent an incorrect cylinder determination. As a result, it is possible to execute the cylinder determining processing for the engine appropriately, and it is possible to resolve several problems due to the incorrect cylinder determination. In addition, it is possible to prevent a damage of the engine and the like. In addition, it is possible to prevent emission of unburned fuel. In addition, according to the embodiment, it is possible to execute a desirable fail safe measure in an occurrence of abnormalities of the crank signal and the cam signal.

It is executed to monitor a condition of the engine speed after the cylinder determining processing using the crank signal alone at the engine starting. If a rise of the engine speed is not detected, the result of the cylinder determining processing is inverted in a front and backside manner. Thereby, it is possible to execute a proper cylinder determining processing at the engine starting.

In the cylinder determining processing using the combination pattern of the crank signal and the cam signal, it is determined whether or not the result of the cylinder determining processing is proper on the basis of the history of the cylinder determining processing for a succeeding plural times. Thereby, it is possible to avoid a possibility of the incorrect cylinder determination due to a noise and the like.

Incidentally, the present invention may be implemented in the following manner.

In an engine in which the crankshaft 10 and the camshaft 20 are mechanically coupled via the chain or the like, a phase difference between the crank signal and the cam signal may be generated at a high-speed. In this case, if the prohibition of the cylinder determining processing is withdrawn while the phase difference continues, there may be an incorrect cylinder determination too. Therefore, in case of becoming the prohibition of the cylinder determining processing due to becoming both the crank signal and the cam signal abnormal, the prohibition of the cylinder determining processing is withdrawn on condition that the engine speed is decreased to a predetermined speed, e.g., about 1000 rpm. Thereby, a reliability of the cylinder determining processing is improved.

The method for detecting the abnormalities of the crank signal and the cam signal may be replaced with another method other than the described method. A system that monitors an existence and an absence of edges of the signals each other at the crank signal interruption and the cam signal interruption may be used.

In the processing in FIG. 9, the history counter is held 0 when the cam inputting corresponding to the crank absence tooth portion is not detected, or a particular cylinder temporary setting of the same cylinder is succeeded. In such the cases, the history of the occurrence of abnormality may be stored by incrementing the abnormality counter. Then, a storing of a diagnosis code, malfunction information, or a warning for a driver on the basis of the abnormality counter may be executed.

The form of the crank signal and the cam signal are not limited in the embodiment, and they may be modified freely on the condition that each has the angle indicating part and the reference position indicating part. In addition, the present invention may be applied for a four-cycle gasoline engine.

Although the present invention has been described in connection with the preferred embodiments thereof with reference to the accompanying drawings, it is to be noted that various changes and modifications will be apparent to those skilled in the art. Such changes and modifications are to be understood as being included within the scope of the present invention as defined in the appended claims.

What is claimed is:

1. An engine control apparatus having a crank sensor for detecting rotation of a crankshaft of a multi-cylinder four-cycle engine and a cam sensor for detecting rotation of a camshaft, the crank sensor outputting a crank signal having an angle indicating part indicating angular positions at every even crank angle interval and a reference position indicating part indicating at least one reference position, and the cam sensor outputting a cam signal having an angle indicating part indicating angular positions at every even cam angle interval and a reference position indicating part indicating at least one reference position, the engine control apparatus comprising:

a first cylinder determining means for executing a cylinder determining processing using the crank signal from the crank sensor; a second cylinder determining means for executing a cylinder determining processing using the cam signal from the cam sensor;

a sensor signal abnormality detecting means for detecting abnormalities of the crank signal and the cam signal respectively; and a cylinder determination controlling means for prohibiting the cylinder determining processing of the first cylinder determining means when both the crank signal and the cam signal become abnormal while operating the engine, and then for withdrawing the prohibition of the cylinder determining processing on the condition that the cam signal is recovered to normal.

2. The engine control apparatus claimed in claim 1, wherein the cylinder determining processing is prohibited when an engine speed is higher than a predetermined speed.

3. The engine control apparatus claimed in claim 1, wherein a result of the cylinder determining processing is inverted oppositely when an increase in engine speed is not detected by monitoring change of the engine speed after completing the cylinder determining processing of the first cylinder determining means when starting the engine.

4. The engine control apparatus claimed in claim 3, wherein the prohibition of the cylinder determining processing caused by the cylinder determination controlling means is withdrawn when the engine stalls.

5. The engine control apparatus claimed in claim 1, wherein a result of the cylinder determining processing is examined to determine whether or not it is correct on the basis of a history of a plurality of successful results of the cylinder determining processing, the history being stored at every cylinder determining processing, in case of executing the cylinder determining processing by referring to reference position detecting data of the cam signal in response to the detection of the reference position of the crank signal.

6. The engine control apparatus claimed in claim 1, wherein the prohibition of the cylinder determining processing is withdrawn on the condition that an engine speed is decreased to a predetermined speed after both the crank signal and the cam signal became abnormal.

7. The engine control apparatus as in claim 1, wherein an engine revolves at a speed higher than at a starting condition when the cylinder determining processing is established.

8. The engine control apparatus as in claim 1, wherein the prohibition the cylinder determining processing is withdrawn based specifically on the condition that the cam signal is recovered to normal so that even if the crank signal is earlier recovered to normal, the cylinder processing using the crank signal alone is still prohibited.

9. The engine control apparatus as in claim 1, wherein the prohibition the cylinder determining processing is withdrawn based specifically on the condition that the cam signal is recovered to normal so that if the crank signal is still abnormal when the cam signal is recovered to normal, the cylinder determining processing is executed by using the cam signal alone.

10. An engine control apparatus having a crank sensor for detecting rotation of a crankshaft of a multi-cylinder four-cycle engine and a cam sensor for detecting rotation of a camshaft, the crank sensor outputting a crank signal having an angle indicating part indicating angular positions at every even crank angle interval and a reference position indicating part indicating at least one reference position, and the cam sensor outputting a cam signal having an angle indicating part indicating angular positions at every even cam angle interval and a reference position indicating part indicating at least one reference position, the engine control apparatus comprising:

a first cylinder determining means for executing a cylinder determining processing using the crank signal from the crank sensor;

a second cylinder determining means for executing a cylinder determining processing using the cam signal from the cam sensor;

a sensor signal abnormality detecting means for detecting abnormalities of the crank signal and the cam signal respectively; and a cylinder determination controlling means for prohibiting the cylinder determining processing of the first cylinder determining means when both the crank signal and the cam signal become abnormal after the cylinder determining processing is established to be performed normally, and then for withdrawing the prohibition of the cylinder determining processing on the condition that the cam signal is recovered to normal.

11. An engine control apparatus having a crank sensor for detecting rotation of a crankshaft of a multi-cylinder four-cycle engine and a cam sensor for detecting rotation of a camshaft, the crank sensor outputting a crank signal having an angle indicating part indicating angular positions at every even crank angle intervals and a reference position indicating part indicating at least one reference position, and the cam sensor outputting a cam signal having an angle indicating part indicating angular positions at every even cam angle intervals and a reference position indicating part indicating at least one reference position, the engine control apparatus comprising:

a first cylinder determining means for executing a cylinder determining processing using the crank signal from the crank sensor;

a second cylinder determining means for executing a cylinder determining processing using the cam signal from the cam sensor;

a sensor signal abnormality detecting means for detecting abnormalities of the crank signal and the cam signal respectively, wherein said abnormalities are a condition of the crank signal that the loss of inputting of the crank signal has occurred and a condition of the cam signal that the loss of inputting of the cam signal has occurred; and a cylinder determination controlling means for prohibiting the cylinder determining processing of the first cylinder determining means when both the crank signal and the cam signal become abnormal while operating the engine, and then for withdrawing the prohibition of the cylinder determining processing on the condition that the cam signal is recovered to normal.

12. A method of controlling an engine having a crank sensor for detecting rotation of a crankshaft of a multi-cylinder four-cycle engine and a cam sensor for detecting rotation of a camshaft, the method comprising:

receiving a crank signal from the crank sensor, the crank signal having an angle indicating part indicating angular positions at every even crank angle interval and a reference position indicating part indicating at least one reference position;

receiving a cam signal from the cam sensor, the cam signal having an angle indicating part indicating angular positions at every even cam angle interval and a reference position indicating part indicating at least one reference position;

executing a cylinder determining processing using the crank signal from the crank sensor;

executing a cylinder determining processing using the cam signal from the cam sensor;

detecting abnormalities of the crank signal and the cam signal; and prohibiting the cylinder determining processing using the crank signal alone when both the crank signal and the cam signal become abnormal while operating the engine, and then withdrawing the prohibition of the cylinder determining processing on the condition that the cam signal is recovered to normal.

13. The method as in claim 12, wherein the cylinder determining processing is prohibited when an engine speed is higher than a predetermined speed.

14. The method as in claim 12, wherein a result of the cylinder determining processing is inverted oppositely when an increase in engine speed is not detected by monitoring change of the engine speed after completing the cylinder determining processing using the crank signal when starting the engine.

15. The method as in claim 14, wherein the prohibition of the cylinder determining processing is withdrawn when the engine stalls.

16. The method as in claim 12, wherein a result of the cylinder determining processing is examined to determine whether or not it is correct on the basis of a history of a plurality of successful results of the cylinder determining processing, the history being stored at every cylinder determining processing, in case of executing the cylinder determining processing by referring to reference position detecting data of the cam signal in response to the detection of the reference position of the crank signal.

17. The method as in claim 12, wherein the prohibition of the cylinder determining processing is withdrawn on the condition that an engine speed is decreased to a predetermined speed after both the crank signal and the cam signal became abnormal.

18. The method as in claim 12, wherein an engine revolves at a speed higher than at a starting condition when the cylinder determining processing is established.

19. The method as in claim 12, wherein the prohibition of the cylinder determining processing is withdrawn based specifically on the condition that the cam signal is recovered to normal so that even if the crank signal is earlier recovered to normal, the cylinder processing using the crank signal alone is still prohibited.

20. The method as in claim 12, wherein the prohibition of the cylinder determining processing is withdrawn based specifically on the condition that the cam signal is recovered to normal so that if the crank signal is still abnormal when the cam signal is recovered to normal, the cylinder determining processing is executed by using the cam signal alone.

21. A method of controlling an engine having a crank sensor for detecting rotation of a crankshaft of a multi-cylinder four-cycle engine and a cam sensor for detecting rotation of a camshaft, the method comprising:

receiving a crank signal from the crank sensor, the crank signal having an angle indicating part indicating angular positions at every even crank angle interval and a reference position indicating part indicating at least one reference position;

receiving a cam signal from the cam sensor, the cam signal having an angle indicating part indicating angular positions at every even cam angle interval and a reference position indicating part indicating at least one reference position;

executing a cylinder determining processing using the crank signal from the crank sensor;

executing a cylinder determining processing using the cam signal from the cam sensor;

detecting abnormalities of the crank signal and the cam signal; and prohibiting the cylinder determining processing using the crank signal alone when both the crank signal and the cam signal become abnormal after the cylinder determining processing is established to be performed normally, and then withdrawing the prohibition of the cylinder determining processing on the condition that the cam signal is recovered to normal.

22. A method of controlling an engine having a crank sensor for detecting rotation of a crankshaft of a multi-cylinder four-cycle engine and a cam sensor for detecting rotation of a camshaft, the method comprising:

receiving a crank signal from the crank sensor, the crank signal having an angle indicating part indicating angular positions at every even crank angle interval and a reference position indicating part indicating at least one reference position;

receiving a cam signal from the cam sensor, the cam signal having an angle indicating part indicating angular positions at every even cam angle interval and a reference position indicating part indicating at least one reference position;

executing a cylinder determining processing using the crank signal from the crank sensor;

executing a cylinder determining processing using the cam signal from the cam sensor;

detecting abnormalities of the crank signal and the cam signal respectively, wherein said abnormalities are a condition of the crank signal that the loss of inputting of the crank signal has occurred and a condition of the cam signal that the loss of inputting of the cam signal has occurred; and prohibiting the cylinder determining processing using the crank signal alone when both the crank signal and the cam signal become abnormal while operating the engine, and then withdrawing the prohibition of the cylinder determining processing on the condition that the cam signal is recovered to normal.

* * * * *